US005237925A

United States Patent [19]

Vogt et al.

[11] Patent Number: 5,237,925

[45] Date of Patent: Aug. 24, 1993

[54] DECELERATION ELEMENT FOR A SUBMUNITION UNIT

[75] Inventors: Karl-Heinz Vogt, Essen; Heinz Olmscheid, Castrop-Rauxel, both of Fed. Rep. of Germany

[73] Assignee: Rheinmetall GmbH, Dusseldorf, Fed. Rep. of Germany

[21] Appl. No.: 897,053

[22] Filed: Jun. 11, 1992

[30] Foreign Application Priority Data

Jun. 18, 1991 [DE] Fed. Rep. of Germany ..... 4120027

[51] Int. Cl.[5] ..... F42B 10/48; F42B 12/58

[52] U.S. Cl. ..... 102/386; 102/489; 244/3.27

[58] Field of Search ..... 244/146, 3.3, 3.27; 102/386, 387, 388, 393, 489, 337, 348, 354

[56] References Cited

U.S. PATENT DOCUMENTS

| | | | |
|---|---|---|---|
| Re. 26,427 | 7/1968 | Jalbert | 244/145 |
| 2,565,470 | 8/1951 | Brown | 102/387 |
| 4,005,655 | 2/1977 | Kleinschmidt et al. | 244/3.27 |
| 4,215,836 | 8/1980 | Zacharin | 244/3.27 |
| 4,565,341 | 1/1986 | Zacharin | 102/386 |
| 4,705,238 | 11/1987 | Gargano | 244/146 |
| 4,753,171 | 6/1988 | Stessen | 102/393 |
| 4,768,739 | 9/1988 | Schnee | 244/146 |
| 4,856,432 | 8/1989 | Synofzik | 102/386 |
| 4,856,737 | 8/1989 | Zacharin | 102/386 |
| 4,860,660 | 8/1989 | Synofzik et al. | 102/386 |
| 4,930,726 | 6/1990 | Jalbert | 244/146 |
| 4,958,565 | 9/1990 | Koch | 102/386 |
| 4,958,566 | 9/1990 | Siebrand et al. | 244/3.27 |
| 5,033,384 | 7/1991 | Eckel et al. | 102/386 |

FOREIGN PATENT DOCUMENTS

| | | |
|---|---|---|
| 3643294A1 | 6/1988 | Fed. Rep. of Germany . |
| 2479136 | 10/1981 | France . |

*Primary Examiner*—David H. Brown

*Attorney, Agent, or Firm*—Spencer, Frank & Schneider

[57] ABSTRACT

A deceleration element is provided for attachment to a tail end of a submunition unit for deployment when the submunition unit is ejected from a spin stabilized carrier projectile for reducing velocity and spin of the submunition unit. The deceleration element includes two approximately circular, air-tight, planar textile fabric layers of essentially the same size having a diameter exceeding the diameter of the submunition unit and circumferentially sewn together to form an inflatable interior between the two fabric layers. The fabric layer disposed closest to the tail end of the submunition unit is clamped by fasteners to the tail end of the submunition unit and has a front side facing the tail end of the submunition unit for encountering air when the deceleration unit is deployed. At least four air capture pockets are disposed at the front side of the one fabric layer and are distributed at regular intervals in a circumferential direction. At least one air inlet opening is provided in the one fabric layer leading to the inflatable interior between the two fabric layers and is disposed in the region of at least one of the air pockets.

12 Claims, 4 Drawing Sheets

DECELERATION ELEMENT FOR A SUBMUNITION UNIT

BACKGROUND OF THE INVENTION

The present invention relates to a deceleration element for attachment to a tail end of a submunition unit for deployment when the submunition unit is ejected from a spin stabilized carrier projectile for reducing velocity and spin of the submunition unit.

EP-A 0,274,580 and corresponding U.S. Pat. No. 4,856,432 disclose a deceleration element of the above type which is composed of fabric or a plastic sheet, has the shape of a disk and may be provided with a supporting structure of radial and crossing strips of webbing or of a hem facing tape. Submunition units accommodated in a carrier projectile are provided with deceleration elements with different dimensions so that the submunition units are decelerated to a different degree after ejection, to thus be separated correspondingly.

The rate of rotation of a submunition unit ejected from a spin stabilized carrier projectile is a function of the firing command and is in a range between 50 and 250 Hz with the traveling velocity of the submunition unit being in a range from 100 to 350 m/s.

SUMMARY OF THE INVENTION

It is an object of the present invention to provide a submunition unit of the type first described above in which the rotation rate and traveling velocity can be reduced within a predetermined period of time to values that permit activation of a larger secondary parachute.

The above and other objects are accomplished according to the invention by the provision of a deceleration element for attachment to a tail end of a submunition unit having a given diameter for deployment when the submunition unit is ejected from a spin stabilized carrier projectile for reducing velocity and spin of the submunition unit, comprising: two approximately circular, air-tight, planar textile fabric layers of essentially the same size having a diameter exceeding the given diameter of the submunition unit and circumferentially sewn together to form an inflatable interior between the two fabric layers; fastening means for clamping one of the fabric layers to the tail end of the submunition unit, the one fabric layer, when so clamped, having a front side facing the tail end of the submunition unit for encountering air when the deceleration unit is deployed; at least four air capture pockets disposed at the front side of the one fabric layer and being distributed at regular intervals in a circumferential direction; and at least one air inlet opening in the one fabric layer leading to the inflatable interior between the two fabric layers and disposed in the region of at least one of the air pockets.

In this way, not only the traveling velocity and spin of the submunition unit can be reduced in a desired manner to values that permit the activation of a larger secondary parachute, initial interferences acting on the submunition unit (due to, for example, the angle of incidence and nutation) are reduced and resonance pendulum effects are also avoided thanks to the direct attachment of the deceleration element in the form of a ballute [=balloon+parachute]. The deceleration element is easy to activate since the spin of the submunition unit results in deployment. Moreover, the structure is well suited for manufacture and working in large numbers.

Further features of the invention are defined in the description that follows.

The invention will now be described in greater detail with reference to embodiments thereof that are illustrated in the attached drawing figures.

DETAILED DESCRIPTION OF PREFERRED EMBODIMENTS

Figure 1:
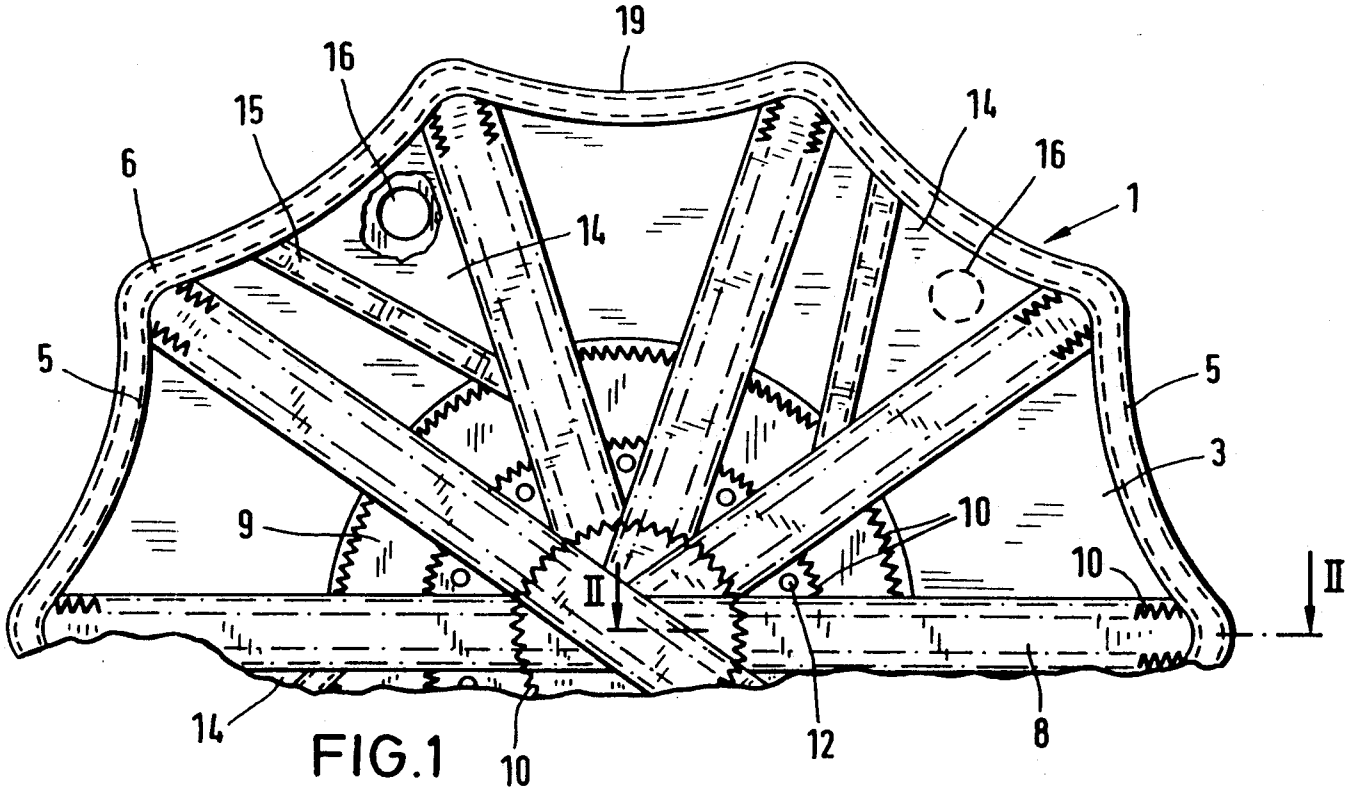
FIG. 1 is a partial plan view of an embodiment of a spread-out deceleration element for a submunition unit seen in the direction of air flow in accordance with the invention.
Figure 3:
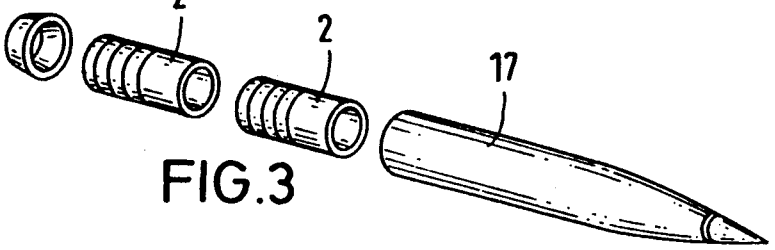
FIG. 3 is a schematic perspective view of a spin stabilized carrier projectile with ejected submunition.
Figure 2:
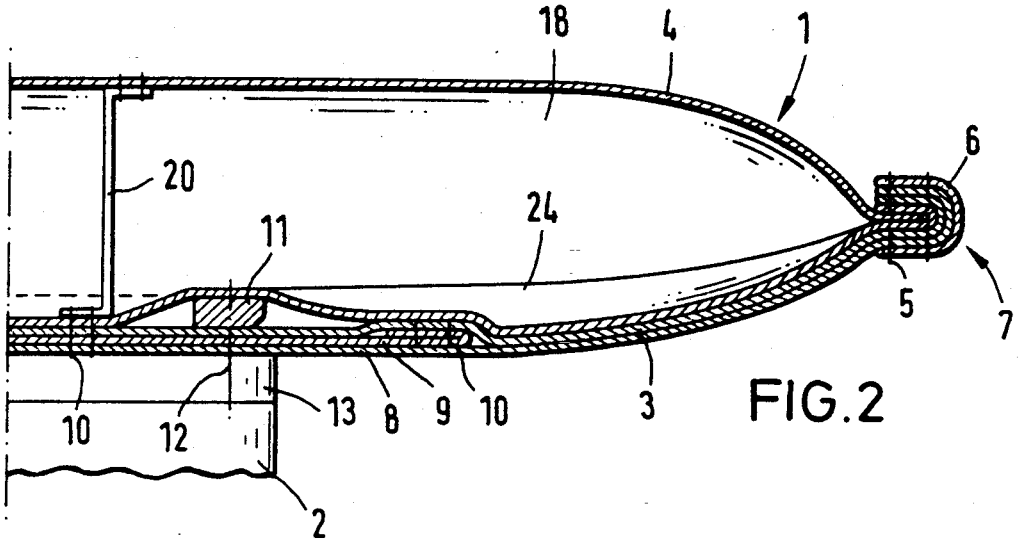
FIG. 2 is a sectional view along line II—II of FIG. 1 with the deceleration element inflated.

Referring to FIGS. 1 and 2, there is shown a deceleration member 1 for a submunition unit 2 composed of two tear-resistant, air-tight fabric layers 3 and 4 of practically the same size which, in the illustrated embodiment, are pieces cut to a decahedral shape. Generally, the textile fabric layers 3 and 4 are circular or polygonal having at least five corners, that is, they are at least approximately circular. The two fabric layers 3 and 4 are connected with one another in their edge regions by one or a plurality of sewn or welded circumferential seams 5 and are reinforced in the edge region by a binding tape 6. The edge of the front fabric layer 3, that is the layer facing (i.e. adjacent) submunition unit 2, is folded back toward the rear. The rear fabric layer 4 is inserted into the thus formed fold, creating a circumferential bead 7 which is additionally reinforced by binding tape 6. A corresponding concentration of masses is thus formed in bead 7 which results in unfolding of the decelerational element under the influence of spin.

In order to transfer centrifugal and opening forces to submunition unit 2, front fabric layer 3 is reinforced by sewed-on or welded-on radial crisscross tapes 8 and/or a disc 9 of a flexible, high strength textile material which is anchored in the center by sewing or welding. If these reinforcing elements 8 and 9 are sewn to fabric layer 3, zigzag seams 10 are preferably employed so as to compensate for differences in the elasticity of the materials.

A ring 11 disposed on the interior of fabric layer 3 serves to fasten the ballute formed of fabric layers 3 and 4 and is connected by way of screws or the like with a part 13 of submunition unit 2 at fastening locations 12 so as to appropriately clamp in fabric layer 3. The number of fastening locations 12 is determined by the geometry of tapes 8 (fastening locations 12 lie between tapes 8), and by the requirement for a circumferentially uniform and sufficiently large clamping effect exerted by ring 11 on fabric layer 3. To avoid damage, ring 11 is provided with rounded edges and a maximum diameter which does not exceed the outer diameter of submunition unit 2.

Several air capture pockets 14 of a textile material are fastened by sewing or welding at regular intervals in the circumferential direction on fabric layer 3. Preferably, at least four such air pockets are provided to ensure the most symmetrical distribution possible. In the illustrated embodiment, there are five air capture pockets 14. For reasons of strength, each one of the triangular air capture pockets 14 is arranged to have one triangular side lie underneath a tape 8 and a further triangular side to be included in the circumferential seam. The remaining side of the triangle which is not connected with fabric layer 3 is preferably given an edge reinforcement 15 in the form of a hem or a seam binding to reliably prevent air capture pocket 14 from flipping over (i.e., turning inside out).

Additionally, fabric layer 3 is provided with at least one, and in the illustrated embodiment shown in FIG. 1, two, air inlet openings 16 which are each disposed underneath an air capture pocket 14 near the outer circumference of fabric layer 3, that is, near bead 7. Air inlet openings 16 may be circular, or in the form of long holes (oriented radially or tangentially) or any type of slot.

When submunition unit 2 is ejected from a spin stabilized carrier projectile 17 (see FIG. 1), it has a certain traveling velocity and a certain spin which leads to opening of the ballute formed of fabric layers 3 and 4. Due to the high tangential velocity after opening, the air is caught in air capture pockets 14, with the surface normal of the air entrance cross sections between air capture pockets 14 and fabric layer 3 preferably being oriented in the direction of the resulting velocity. At the same time, air is introduced through air inlet openings 16 into the space 18 between fabric layers 3 and 4 and thus the ballute is inflated. When the ballute is filled due to the traveling velocity that is present primarily axially, the surface normal of the air entrance cross sections should preferably likewise be oriented primarily axially or radially inwardly. The air inlet openings 16 preferably are arranged on a circle near the outer circumference or border of the fabric layer 3 and are able to optimally utilize the resulting incident flow velocity (traveling and tangential velocity). The total air entrance cross section of air inlet openings 16 should be selected to be as large as possible so as to fill the ballute quickly.

The shape of the filled ballute results from the relationship of the forces generated by the internal pressure, the dynamic pressure and the spin rate. In order to realize the greatest possible effective deceleration surface, it is advisable to provide recesses 19 between the corners of the polygonal fabric layers 3 and 4 so that the possibly uncontrollable formation of sharp bends or creases along the circumference, which would not occur with circular fabric layers 3 and 4, is avoided. Moreover, a large area, flat cushion shape of the ballute can be ensured by the provision of spacer tapes 20 which, depending on the diameter of the ballute, are inserted only in the center and/or in a circular array toward the outer circumference. These spacer tapes connect the two fabric panels 3 and 4 with one another and thus limit expansion of the ballute in the axial direction of submunition 2. Instead of individual spacer tapes 20, radially arranged spacer ribs of a textile material that are sewn or welded to fabric panels 3 and 4 can also be employed to define the thus predetermined outline.

Figure 4:
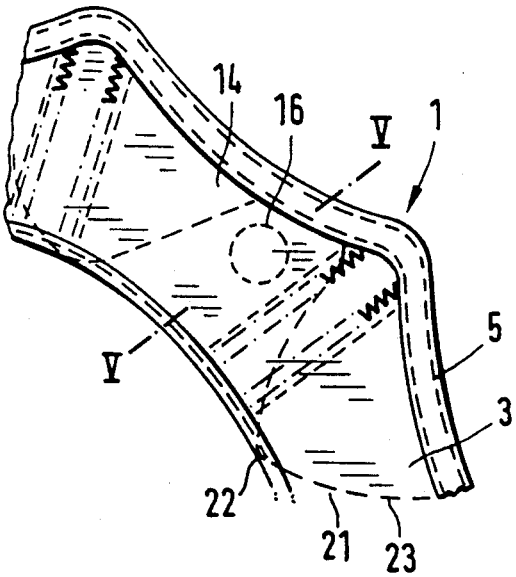
FIG. 4 is a partial plan view similar to that of FIG. 1 showing a further embodiment of the invention.
Figure 5:
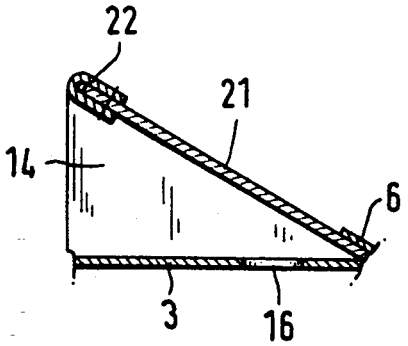
FIG. 5 is a sectional view seen along line V—V of FIG. 4.

As shown in FIG. 4, instead of being formed of triangular fabric pieces, air capture pockets 14 may be formed by means of a circumferential ring 21 of a textile material that is incorporated in the edge seam or weld 5 along the circumference. In this case, the outer diameter of ring 21 is selected to be larger than the sewn diameter of the ballute and the inner edge of ring 21 is reinforced by a hem or a hem tape 22. Air capture pockets 14 result from a wavy seam 23 between ring 21 and fabric layer 3, and between the inner and outer diameters of ring 21. The number of air capture pockets 14 depends on the length of the waves and the width of the opening of the pockets depends on the outer diameter of the ballute and the inner diameter of ring 21. Air inlet openings 16 are again preferably disposed toward the tip of each pocket.

Figure 6:
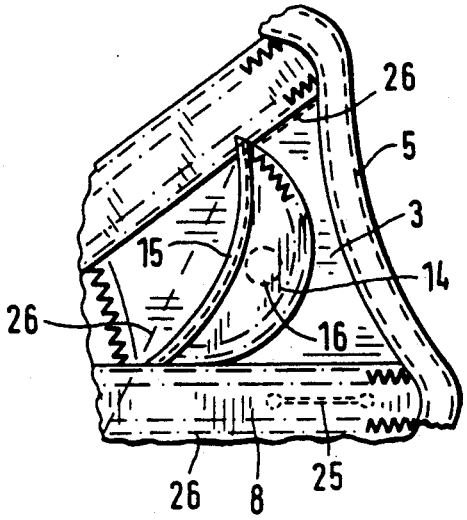
FIG. 6 is a partial plan view of an additional embodiment of a deceleration element seen in the direction of air flow according to the invention.

Air capture pockets 14 may also be placed on top of fabric layer 3, with their orientation taking advantage of both flow directions as shown in FIG. 6.

The ballute's ability to decelerate is determined to a great degree by its internal pressure. To maintain this internal pressure, even at low spin rates, the embodiment shown in FIGS. 1 and 2 includes between fabric layers 3 and 4 a sealing layer 24 that is folded over in circumferential seam 5 and sewn (or welded) into the hem over the entire circumference. In this way, the interior of the ballute is divided into two chambers which are in communication with one another by way of passage openings 25 of any desired shape in flexible sealing layer 24 (see, for example, FIG. 6). As is evident from FIGS. 2 and 6, the volume of the frontal chamber is defined by the attachment of sealing layer 24 to front fabric layer 3 by way of circumferential seam 5 and/or by fixing sealing layer 24 to fabric layer 3 by seams 26 (or corresponding welds) that form segments in the outer region around passage openings 25.

Figure 7:
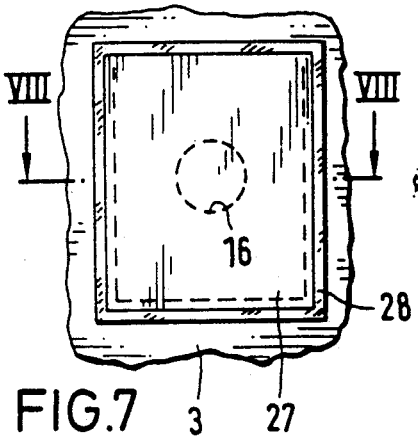
FIGS. 7 and 8 are a plan view and a sectional view, respectively, of a valve for a deceleration element according to a further aspect of the invention.
Figure 8:
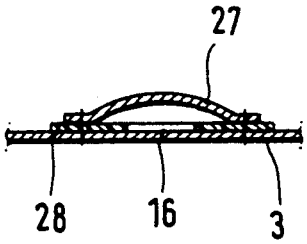
Figure 9:
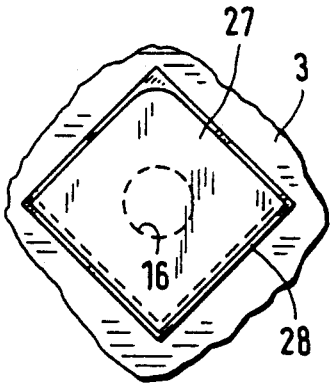
FIG. 9 is a plan view of a variation of the valve of FIGS. 7 and 8.

The sealing of the individual air inlet openings 16 may also be effected by means of flap-like valves 27 of a textile material which are sewn or welded to the interior face of fabric panel 3 either in the shape of the letter U as shown in FIGS. 7 and 8, or an angle, leaving a radial or tangential opening as shown in FIG. 9. In both cases, a rubberized intermediate layer 28 may be utilized as shown in FIGS. 7 to 9.

Figure 10:
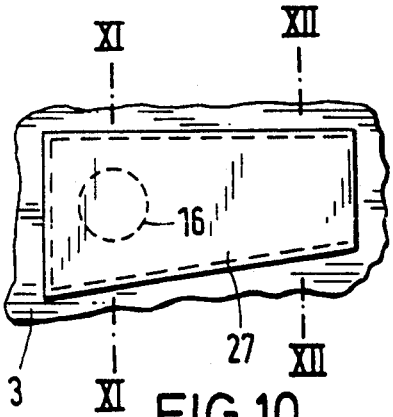
FIGS. 10 to 12 are a plan view and two sectional views seen along lines XI—XI and XII—XII, respectively, of a further embodiment of a valve.
Figure 11:
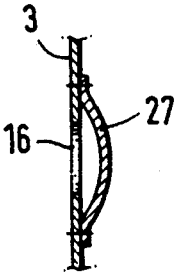
Figure 12:
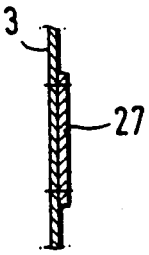

Valve 27 may also be formed by a flap as shown in FIGS. 10 to 12 which is connected with fabric layer 3 on three sides and balloons out above air inlet opening 16 to form an appropriate space, with this space decreasing in size toward the outlet end.

The material employed for valves 27 preferably has a smooth surface.

Figure 13:
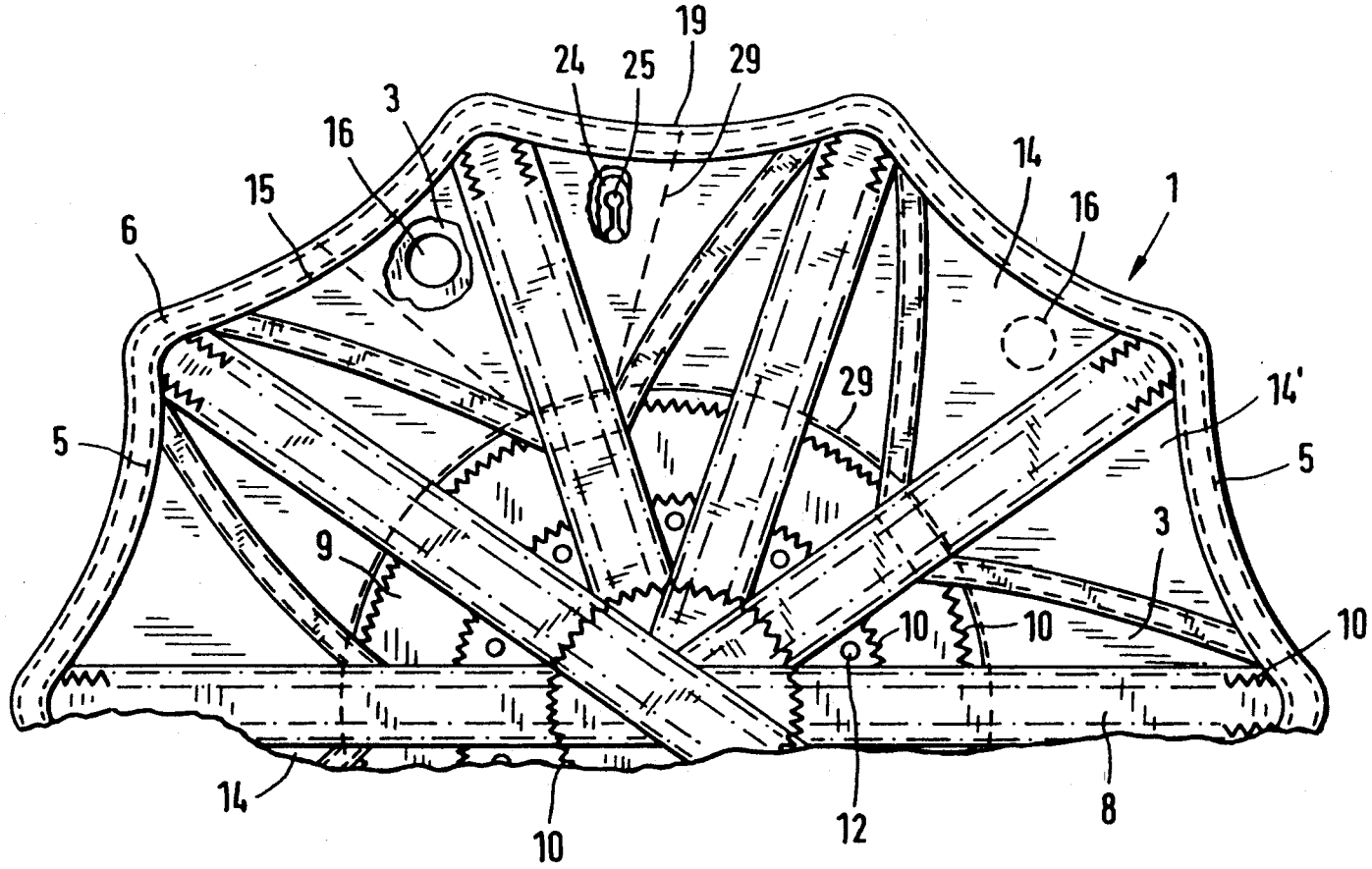
FIG. 13 is a partial plan view of an additional embodiment of a spread-out deceleration element seen in the direction of air flow according to the invention.

In the embodiment shown in FIG. 13, air capture pockets 14 have an essentially triangular shape and are arranged symmetrically underneath every other circumferential end region of tape 8 and along the circumference underneath seam 5. Additionally, pockets 14 are sewn to fabric layer 3 by way of the seams 10 of tapes 8. This not only produces an air capture pocket 14 with an air inlet opening 16 disposed underneath at its tip to fill the ballute, but also a further air capture pocket 14' with an opposite orientation. This makes it possible to generate a torque as a function of the momentary spin rate corresponding to the configuration and orientation (height, angle with respect to the resulting incident flow) of air capture pockets 14 and 14' (which may not necessarily be arranged symmetrically) and an additional velocity dependent torque by deflection of the current in a direction opposite to the momentary direction of rotation. Both of these effects act to reduce the spin rate until a constant residual spin rate for example, about 10 Hz is reached. In this way, the stability of submunition unit 2 during the deceleration phase is also increased in that the spin rate is reduced more slowly. The magnitude and direction of the transfer rate can be selected as a function of the secondary parachute system.

In this connection, it is advisable, if seams 29 are provided between front fabric layer 3 and sealing layer 24, to make these seams circumferential and segmental in the of air capture pockets 14 and 14'.

Passage openings 25 in sealing layer 24 are advisably provided at a distance from air inlet openings 16.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A deceleration element for attachment to a tail end of a submunition unit, having a given diameter, for deployment when the submunition unit is ejected from a spin stabilized carrier projectile for reducing velocity and spin of the submunition unit, comprising:

two approximately circular, air-tight, planar textile fabric layers of essentially the same size having a diameter exceeding the given diameter of the submunition unit and circumferentially sewn together to form an inflatable interior between the two fabric layers;

fastening means for clamping one of the fabric layers to the tail end of the submunition unit, said one fabric layer having a front side facing the tail end of the submunition unit when so clamped for encountering air when the deceleration unit is deployed;

at least four air capture pockets disposed at the front side of the one fabric layer and being distributed at regular intervals in a circumferential direction;

at least one air inlet opening in said one fabric layer leading to the inflatable interior between the two fabric layers and disposed in the region of at least one of said air pockets; and a sealing layer with passage openings therein disposed between said two fabric layers in order to seal the at least one air inlet opening against the exterior.

2. A deceleration element as defined in claim 1, wherein said air capture pockets comprise triangular textile fabric pieces connected at two sides with said one fabric layer.

3. A deceleration element as defined in claim 1, wherein said air capture pockets comprise a textile ring connected with said one fabric layer at the circumference thereof and a seam having a wave shape sewn between said textile ring and said one fabric layer and between an inner and outer diameter of said textile ring.

4. A deceleration element as defined in claim 1, wherein at least two of said air capture pockets are arranged to form a pair of oppositely directed air capture pockets.

5. A deceleration element as defined claim 1, wherein said air capture pockets have free edges that are reinforced.

6. A deceleration element as defined in claims 1, and further including at least one flap-like valve made of a textile material and disposed on a sides of said one fabric layer opposite from said front side so as to cover the at least one air inlet opening.

7. A deceleration element as defined in claim 1, and further including reinforcement means comprising a high strength textile material attached to said one fabric layer for reinforcing said one fabric layer.

8. A deceleration element as defined in claim 1, forming a combination with a submunition unit, said combination comprising:

a submunition unit having a tail end to which said deceleration element is attached.

9. A deceleration element as defined in claim 1, wherein said at least one air inlet opening is disposed near an outer circumferential region of said one fabric layer.

10. A deceleration element as defined in claim 9, wherein said at least one air inlet opening comprises a plurality of air inlet openings arranged on a circle near the outer circumferential region of said one fabric layer.

11. A deceleration element as defined in claim 1, and further including spacer tapes disposed between and connecting together said two fabric layers.

12. A deceleration element as defined in claim 11, wherein said spacer tapes have a length and are so arranged that the deceleration element, when inflated, takes on a shape of a flat cushion.

* * * * *